United States Patent [19]

Del Fabro et al.

[11] Patent Number: 4,732,066

[45] Date of Patent: Mar. 22, 1988

[54] DEVICE TO FEED BARS

[75] Inventors: Marcello Del Fabro, Udine; Giorgio Del Fabro, Montegnacco, both of Italy

[73] Assignee: S.A.E. Srl Societa Automatismi Elettronici, Tavagnacco, Italy

[21] Appl. No.: 821,057

[22] Filed: Jan. 21, 1986

[30] Foreign Application Priority Data

Jan. 21, 1985 [IT] Italy ..... 83317 A/85

[51] Int. Cl.[4] ..... B26D 5/20

[52] U.S. Cl. ..... 83/277; 83/268; 83/467 A; 414/745; 414/28; 198/456; 198/624

[58] Field of Search ..... 72/424, 324; 83/268, 83/269, 277, 467 R, 467 A, 468; 414/745, 748, 28; 198/456, 782, 624

[56] References Cited

U.S. PATENT DOCUMENTS

| | | | |
|---|---|---|---|
| 1,392,871 | 10/1921 | Heffelfinger | 83/277 |
| 3,045,846 | 7/1962 | Clark | 414/745 |
| 3,542,226 | 11/1970 | Hutton, Jr. | 414/745 |
| 3,647,092 | 3/1972 | Bulat et al. | 414/28 |
| 3,832,928 | 9/1974 | Copeland | 83/467 |
| 3,871,288 | 3/1975 | White | 414/748 |
| 4,104,790 | 8/1978 | Hindrichs | 414/745 |
| 4,182,206 | 1/1980 | Millar et al. | 83/277 |
| 4,204,788 | 5/1980 | Massey | 414/745 |
| 4,524,656 | 6/1985 | Del Fabro et al. | 83/277 |
| 4,579,498 | 4/1986 | Lukkari et al. | 414/745 |

FOREIGN PATENT DOCUMENTS

| | | | |
|---|---|---|---|
| 20775 | 2/1961 | Fed. Rep. of Germany | 83/277 |
| 1114164 | 9/1961 | Fed. Rep. of Germany | 83/467 |
| 1235433 | 3/1967 | Fed. Rep. of Germany | 83/467 |
| 2352469 | 5/1974 | Fed. Rep. of Germany | 83/277 |
| 194936 | 11/1984 | Japan | 414/745 |
| 650913 | 3/1979 | U.S.S.R. | 414/28 |

*Primary Examiner*—Daniel C. Crane

*Attorney, Agent, or Firm*—Lee C. Robinson, Jr.

[57] ABSTRACT

A device to feed bars located upstream of a machine to shear bars to size from a bundle to be sheared, the single bars being withdrawn from a selected bundle of bars, a bundle of aligned and butted bars for shearing being delivered to such shearing machine by at least one support frame holding a bundle of bars to be sheared. A movable carrier advances the support frame. An assemblage to align and abut the bundle of bars prepares the bars for shearing. The assemblage to align and abut the bundle of bars including a movable gripper into which the bundle of bars are introduced and a movable abutment plate for contacting and aligning the bundle of bars.

14 Claims, 14 Drawing Figures

DEVICE TO FEED BARS

This invention concerns a device to feed bars advantageously, but not only, to machines which cut bars to size. Various types of machines are known in the present state of the art which shear bars after extracting them from stored bundles of bars.

The shearing of bars is necessary so as to have sections of bars available which are of a required size and can be used straight or specially shaped, for instance in reinforced concrete structures.

The shortcomings to be found in known machines lie in the fact that the withdrawal of bars from their bundle takes place in a substantially haphazard manner, and therefore the heads of the bars are not aligned. This entails the need to perform a first facing shearing operation so as to obtain alignment, with a resulting loss of time and waste of material.

The purpose of the present invention is to avoid the foregoing shortcomings and also to simplify the operations to be undertaken by the machine operator and to make his work less burdensome.

This latter aspect in particular becomes very important when we consider the burdensome nature of the work involved in the withdrawal and/or selection of one single, or more, bars from the bundle to which it belongs, such withdrawal now being performed normally by hand.

According to the invention, there is provided a device to feed bars which is suitable to take them from a bundle, to arrange them with their front portions aligned and to deliver them upstream of, and in cooperation with, a machine which shears bars.

The invention can be applied either to stationary bar-shearing machines served by movable stores of bundles of bars or to movable bar-shearing machines served by stationary or substantially stationary stores of bundles of bars, that is to say, stores able to move only within a limited space.

The invention is best applied advantageously to stationary bar-shearing machines served by movable stores of bundles of bars. The invention will be described hereinafter in such a lay-out alone, for the purpose of giving an example and for simplicity of treatment.

According to the invention the machine operator has only to arrange to insert the end of one or more bars in an appropriate device.

The device of the invention firstly permits the operator to perform only the above operation and thereafter arranges to align the heads of the bars and to deliver such aligned bars to the machine for the shearing process.

To obtain this the invention arranges that, when the diameter or length or type of the bar is to be changed, a movable support frame, which is employed momentarily for that given size or type and therefore holds a bundle of bars having the required characteristics, is traversed sideways until it is in line with the shearing machine.

When such movable support frame is positioned in line with the machine, it is moved lengthwise and takes with it the required bundle of bars.

An appropriate trough to hold the front ends of the bars is provided to keep the bars in position in their bundle and to prevent them from moving lengthwise farther than they should.

According to the invention the operator selects one or more bars at a time and positions a plurality of them such as is compatible with the shearing capacity of the shearing machine. The operator has only to take one or more bars and put them in a movable gripper, which will accommodate other bars too up to a compatible number of them.

Such movable gripper works in cooperation with alignment means, abutment plate means for instance, which align, within a very small allowance, all the front ends of the bars then forming the bundle to be sheared.

When the front ends have been aligned and thus easily butted without producing scrap and without useless effort on the part of the operator, the bundle of bars to be sheared is arranged for delivery to the machine for the shearing operation.

The invention provides also means, possibly able to be adjusted by the operator, which serve to bring the upper side of the bars to be selected to a required height so as to facilitate their handling and extraction from the bundle.

The invention is therefore embodied in a device to feed bars which is located upstream of a machine to shear bars to size and cooperates with a store of bundles to be sheared, the single bars being withdrawn from a selected bundle of bars, a bundle of aligned and butted bars for shearing being delivered to such shearing machine, the device being characterized by comprising in cooperation:

at least one support frame holding a bundle of bars to be sheared, means to advance the support frame, and an assemblage to align and butt the bundle of bars so as to prepare them.

Let us now see a preferred embodiment of the invention with the help of the attached figures, which are given as a nonrestrictive example and in which:

FIG. 1 gives a three-dimensional view of a device of the invention combined with a shearing machine;

FIGS. 5*a* to 5*d* show the working cycle of the feeder means.

Figure 1:
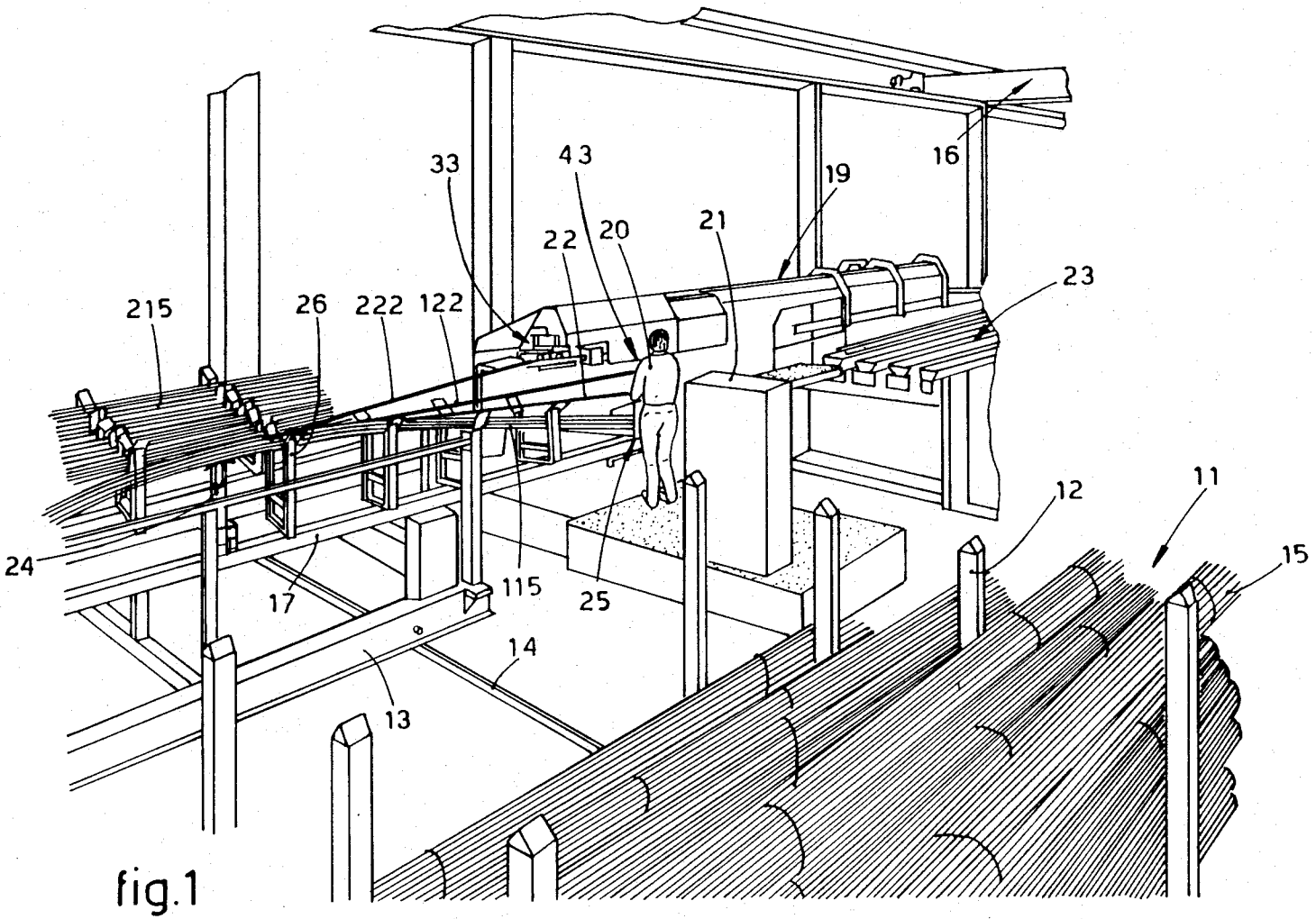

In FIG. 1 the invention comprises a store 11 of bundles of bars 15 split up by diameters or dimensions or characteristics by means of vertical separators 12.

At the side of the store 11 is positioned a carriage 13 able to move sideways on rails 14. Bundles of bars 115–215 taken from the store 11 by a bridge crane 16 and split up by diameters, dimensions and/or characteristics are loaded onto the movable carriage 13 and are held on container forks 26. The movable carriage 13 is equipped with support fromes 17 able to move lengthwise.

A bundle of bars 115 of the required type is selected (hereinafter we shall deal only with bars in general so as to simplify the description), and the support frame 17 holding that bundle 115 is brought into cooperation with a shearing machine 19, or, if there is a separate alignment and abutment assemblage 43, into cooperation with such alignment and abutment assemblage 43.

Figure 2:
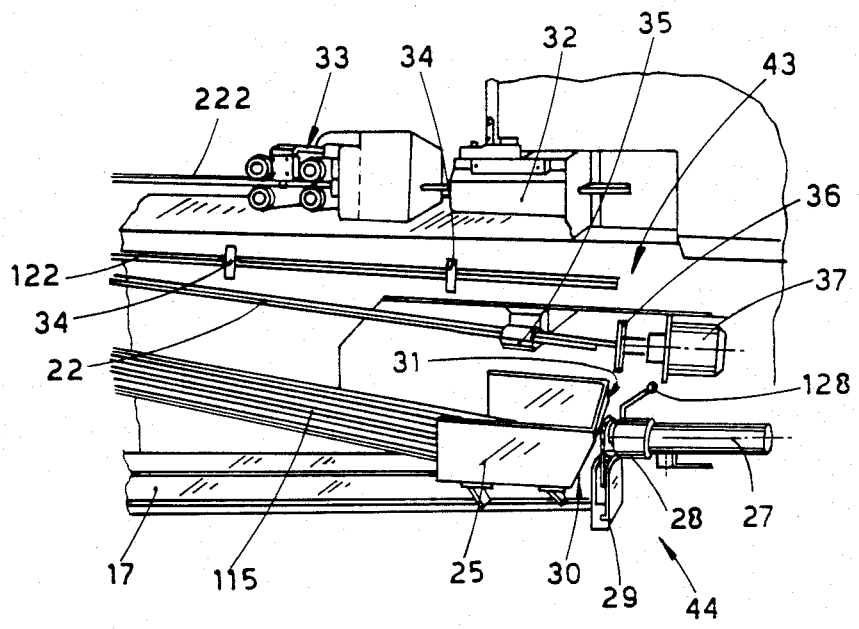
FIG. 2 shows a detail of a part of the device of the invention.

The required support frame 17 is firstly positioned laterally and then moved lengthwise by advancement means 44 (see FIG. 2).

By acting on an insertion handle 128 an extraction hook 28 is attached to the support frame 17, which comprises a frontal latch 29.

When the extraction hook 28 has been attached to the latch 29, the operator 20 acts on a jack 27 by means of a control panel 21, extracts the support frame 17 from the movable carriage 13 and positions such frame near to and in cooperation with the alignment and abutment assemblage 43.

When the support frame 17 has been positioned near the assemblage 43, the operator acts on an intermediate lifter means 24, which thus supports in a balancing condition the bundle 115 positioned on the support frame 17.

The intermediate lifter means 24 may consist of an electrical, pneumatic or hydraulic jack or of a system of levers or a pantograph system and will be able to be extended to various lengths to suit the operator's requirements. It serves firstly to facilitate engagement of the single bars and then to facilitate their withdrawal fram a bundle. The balancing condition imparted to the bundle enables the operator to position the bars with a minimum of effort.

In fact, owing to the lifter means 24 the operator 20 has only to position the front ends of the bars in the alignment and abutment assemblage 43; he no longer has to select and release the individual bars from the bundle, this being a very burdensome operation involving a waste of time. Moreover, the lifter means 24 enables the bundle of bars to be positioned at the most convenient height on each occasion while the bundle is being used up.

Even if the individual bars of the bundle 115 are lifted thus, they do not leave the support frame 17 sideways owing to the presence of the lateral container forks 26.

The support frame 17 comprises at its front end a container trough 25 in which are positioned the ends of the single bars of the bundle 115.

The front terminal portion of such trough 25 is conformed with one side 30 inclined less then 60° to the horizontal and with a substantially vertical upward extension 31 of such side 30.

The inclined side 30 serves to facilitate the upward withdrawal of the single bars, whereas the vertical extension 31 prevents the single bars leaving the trough 25 by sliding on the inclined side 30 during the lengthwise movement of the support frame 17.

When the support frame 17 has been positioned to cooperate with the alignment and abutment assemblage 43, the operator 20 takes one or more bars at a time and positions them within an open movable gripper 35. In the example shown the operator has only to lift the front terminal portion of one or more bars and to place it within the open movable gripper 35.

Figure 4:
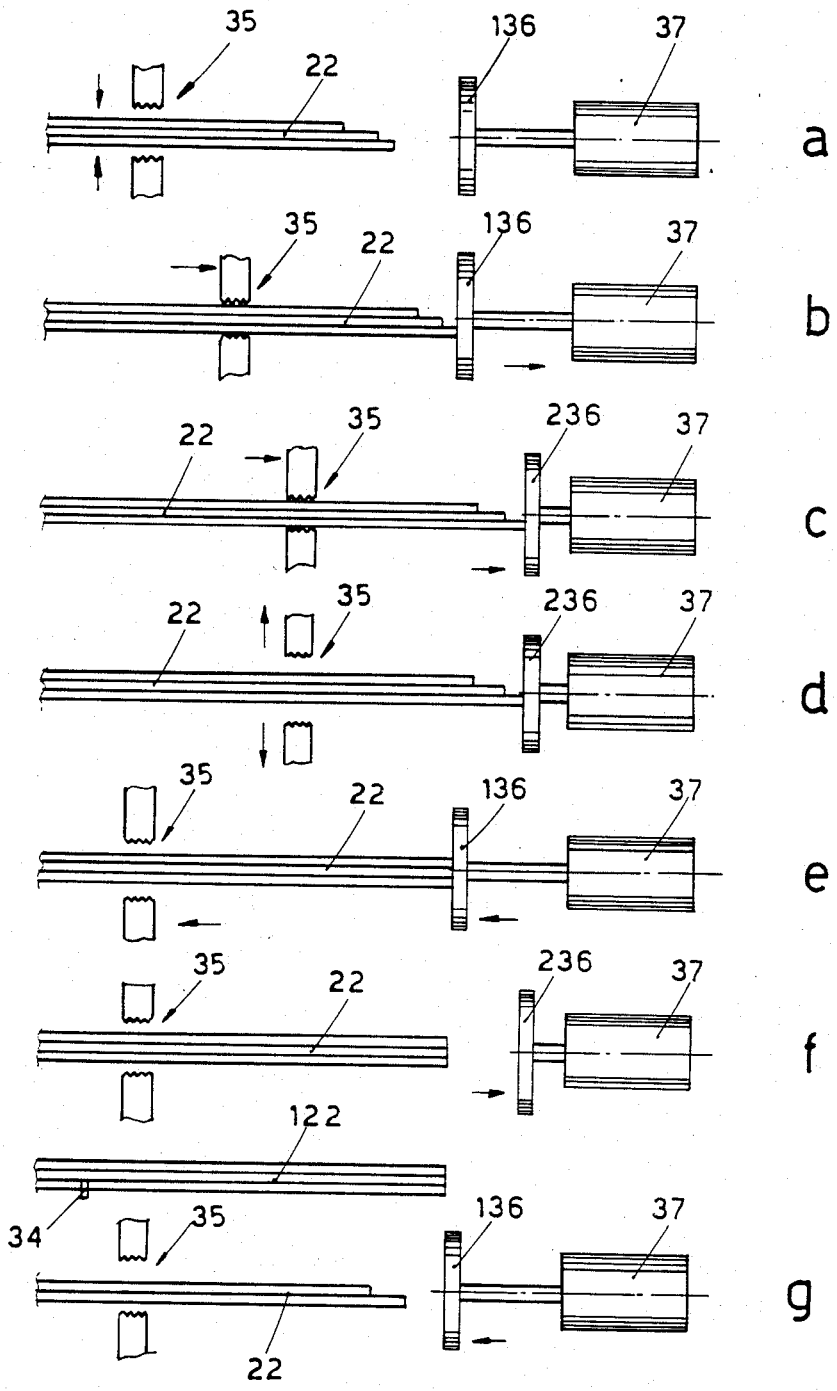
FIG. 4 shows the alignment and butting cycle.

The operator 20 will position within the open gripper 35 (FIG. 4*a*) as many bars as can be sheared by the shearing machine in one single stroke.

Figure 3:
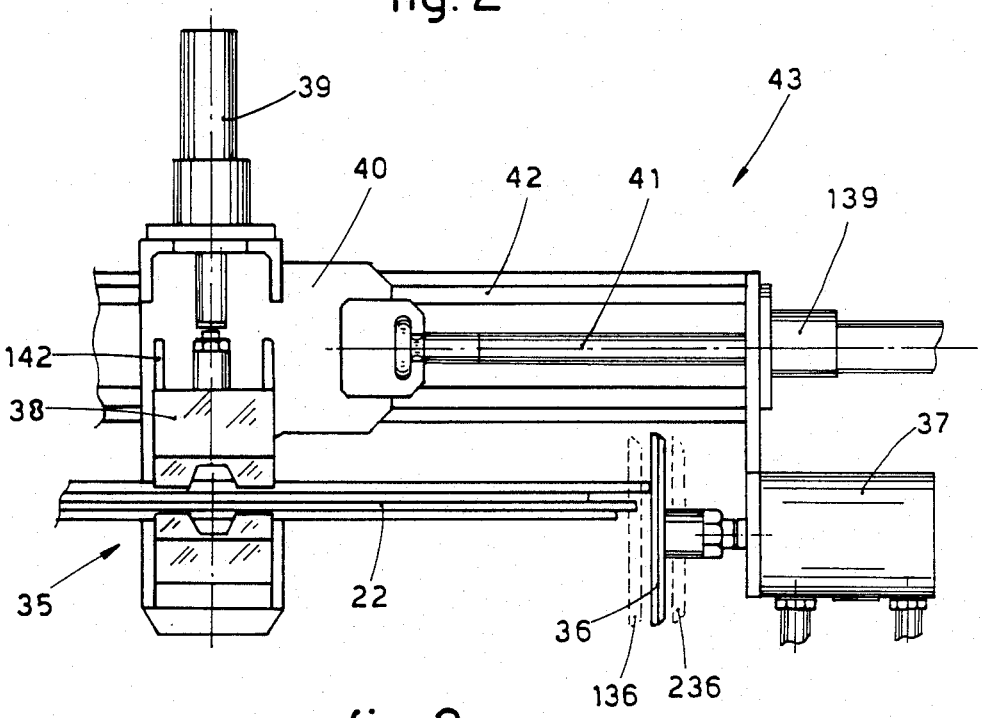
FIG. 3 shows a plan view of the alignment and abutment device.

The gripper 35 and the means which move it (FIG. 3), an abutment plate 36 and a jack 37 constitute the alignment and abutment assemblage 43.

The plurality of bars involved in the preparation step is referenced with 22 and is positioned with the end portions not aligned (FIGS. 4*a*-4*b*-4*c*-4*d*).

When the required number of bars has been introduced into the movable gripper 35, the latter is closed (FIG. 4*b*) and is displaced lengthwise to the bars (FIGS. 4*b*–4*c*). Such movements can be produced automatically or semi-automatically.

When the bundle of bars 22 is moved with the gripper 35, it comes into contact with the abutment plate 36 at the fully forward position 136 of such plate and pushes it backwards to its fully backward position 236, thus overcoming the resistance of the jack 37, which is not under pressure.

The movable gripper 35 (FIG. 4*d*) is then opened and retreats and is re-positioned (FIG. 4*e*), while the abutment plate 36 returns to its fully forward position 136 by reason of the now pressurized jack 37 and aligns the ends of the bars forming the bundle 22.

If the step shown in FIGS. 4*d* and 4*e* is not enough to align all the bars, the cycle from 4*a* to 4*e* can be repeated several times.

In a variant the intermediate lifter means 24 can be provided also with a vibratory movement, at least during the step of aligning the ends of the bars (FIGS. 4*d* and 4*e*).

In another variant presented also to cooperate with the above variant, the abutment plate 36, at least during the alignment step, can also be provided with a vibratory and/or knocking movement.

When the bars (FIG. 4*e*) have been aligned, the abutment plate 36 retreats and takes up its fully backward position 236 once more (FIG. 4*f*). This serves to enable the plurality of aligned bars to be lifted freely thereafter without coming into contact with the abutment plate 36.

The bundle 22 of bars with their ends aligned is then transferred onto supports 34 (FIG. 4*g*), being already prepared (122) and waiting for a bundle already positioned for shearing 222 to be finally sheared so that it can be replaced.

While the prepared bundle 122 is positioned on the supports 34, the operator can form a new bundle 22 and repeat the alignment and abutment cycle (FIG. 4) without any idle times intervening.

In the example shown the movable gripper 35 consists of a stationary jaw and a movable jaw 38, which slides on guides 142 and is actuated by a jack 39.

The movable gripper 35 is supported on a gripper-bearing carriage 40, which runs in guides 42 and is driven by a jack 139 by means of a shaft 41.

When the bundle 222 awaiting shearing has been sheared, the prepared bundle 122 is brought onto the shearing line, being taken and lifted by feeder means consisting, for instance, of an engagement and lifter means 33 and by a clamping gripper 32, which together arrange to feed shears 19 possibly equipped with means 23 to discharge sheared bars.

Figure 5A:
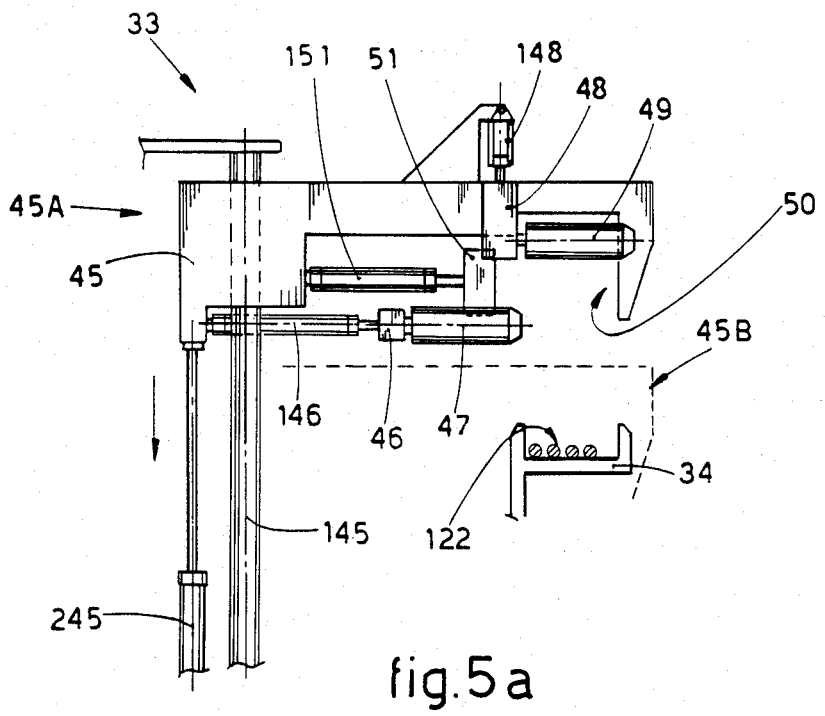
Figure 5B:
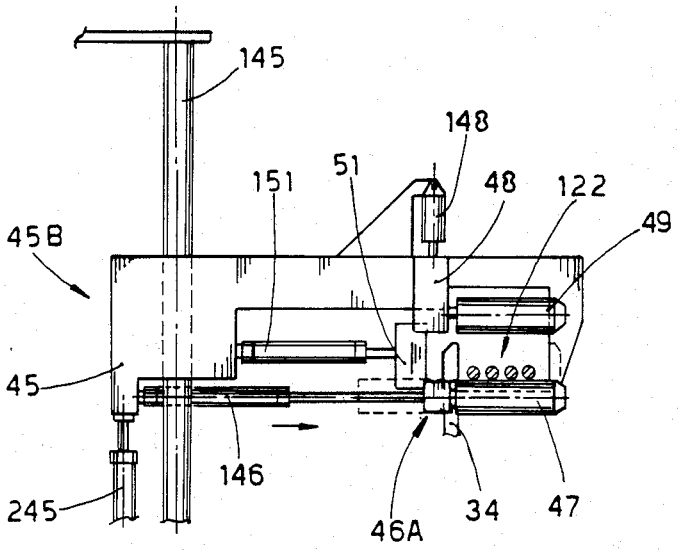

FIGS. 5*a* and 5*b* show the working cycle of the engagement and lifter means 33, which comprise a main casing 45 able to move vertically from a position 45*a* to a position 45*b* and vice versa.

The prepared bundle 122 held on the supports 34 is engaged at position 45*b*, whereas the bundle at 222 in FIG. 1 is fed to the shears at position 45*a*.

The main casing 45 is driven by a jack 245 along vertical guides 145.

Two sets of idler rollers, a lower set 47 and upper set 49, are included to take the prepared bundle 122 from the supports 34.

The lower rollers 47 are supported by a casing 46 which can be moved horizontally by an actuator 146. Such movement is necessary to enable the roller 47 to pass under the prepared bundle 122 so as to engage it (see FIG. 5*b*). Instead, the upper rollers 49 are fitted to the end of a casing 48 which can be moved vertically to secure the prepared bundle 122 when the latter is rested on the lower roller 47.

This vertically movable casing 48 is driven by a jack 148. A movable abutment 51 is also included and is driven by a jack 151; it has the task of clamping laterally against a stationary abutment 50 on the main casing 45 the prepared bundle 122 of bars already engaged between the upper and lower rollers 49–47.

The cycle of engaging and lifting the prepared bundle 122 to feed the shears at position 222 in FIGS. 1 and 2 takes place as follows according to FIGS. 5*a* and 5*b*.

The main casing 45 lies initially at position 45*a* (FIG. 5*a*) and is brought by the jack 245 to position 45*b* shown with lines of dashes in FIG. 5*a*.

The horizontally movable casing 46 with the lower rollers 47 is retracted, as also is the movable abutment 51. In this way the whole casing 45 can be brought to position 45*b* (FIG. 5*b*) without coming into contact with the prepared bundle 122.

Next, the horizontally movable casing 46 is brought to its forward position 46A by the jack 146. The lower roller 47 is thus brought under the prepared bundle 122. The bevelled end of the roller 47 enables it to pass along the edge of the prepared bundle 122 without coming into contact with it.

The vertically movable casing 48 is now lowered (FIG. 5*c*) to a position 48A for securing the prepared bundle 122 owing to the action of the jack 148.

Position 48A will be adapted to suit the diameter of the bars forming the prepared bundle 122, for the halting of the vertically movable casing 48 is determined precisely by the abutment of the set of upper rollers 49 against the prepared bundle 122. The movable abutment 51 is now moved forward by the jack 151 to a forward position 51A determined by the prepared bundle 122.

In this case the halting of the abutment 51 at 51A is determined by the same prepared bundle 122, whatever the number of bars present may be.

The bars in the prepared bundle 122 are now (FIG. 5*c*) firmly clamped between the upper and lower idler rollers 47–49 and the respective stationary and movable abutments 50–51.

Figure 5C:
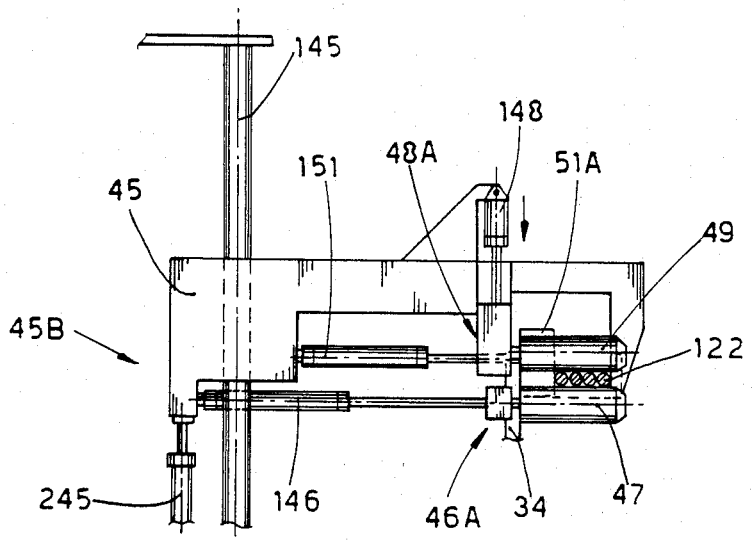
Figure 5D:
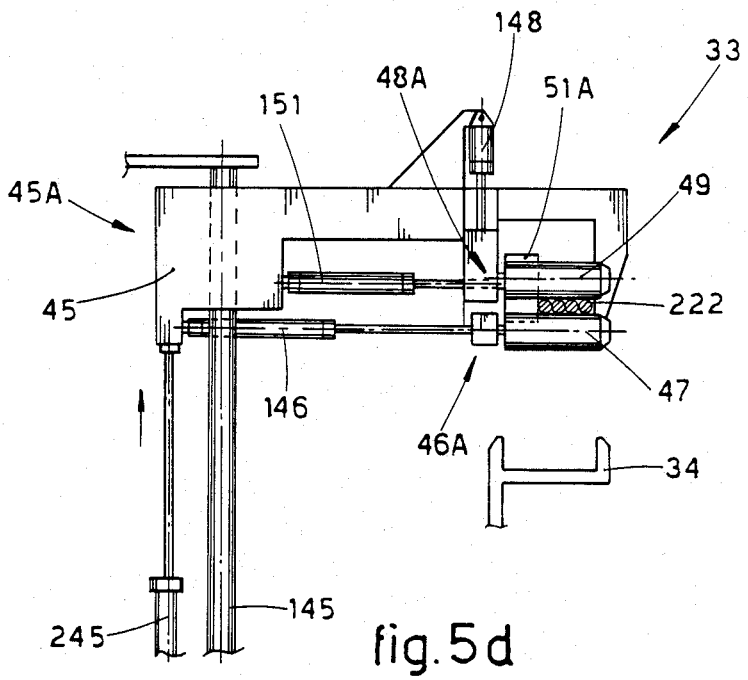

The main casing 45 is now raised again with a movement shown by an arrow in FIG. 5*d*.

The prepared bundle 122 is therefore taken from the supports 34 and brought to the feeding position (222). The bundle in the feeding position 222 can now be fed to the shears by the clamping gripper 32 (FIG. 2).

The movable abutment 51 may be slackened to assist the sliding of the bundle, for instance by releasing the pressure in the jack 151.

Next, when the bundle 222 has been discharged by the feeder means 33, the horizontally and vertically movable casings 46–48 are brought back to their starting positions of FIG. 5*a* to begin a new cycle.

It is obvious that the steps we have now described can also partially overlap one another momentarily, particularly as regards the engagement of the prepared bundle 122 by the upper roller 49 and the movable abutment 51 (51A in FIG. 5*c*).

It can be understood from the foregoing that the bundle takes up altogether four vertically arranged, successive positions, of which one 115 is a position of balancing on the support frame 17, another 22 is a position of engagement by the movable gripper 35 and abutment plate 36, another 122 is an intermediate position on the supports 34 and the last is the feeding position 222.

The employment of the intermediate position 122 between the butting of the bars and their feed to the shears is necessary to make the butting performed by the operator independent of the loading of the shears by the feeder means 33 and the clamping gripper 32.

The means to move, shear and discharge the bars have been mentioned only to complete the description so as to give a clearer background of the invention and may therefore be of any required type.

The transfer of the bundle onto the supports 34 may be carried out by hand, as in the example shown, or automatically or semi-automatically; in the last two cases the supports, for instance, will return, descend, move forward below the bars and lift them in a manner analogous to that described regarding the feeder means 33.

Instead of such a system, a variant provides for transfer arms means which displace the aligned bundle from its butting position 22 to its prepared position 122.

According to the embodiment shown the bundles 115, 122 and 222 are positioned in the neighbourhood of one single plane, which can be oriented as required but will advantageously be substantially vertical, as shown in FIGS. 1 and 2, for instance.

INDEX

11—store
12—separators
13—movable carriage
14—rails
15—bundles of bars
115—bundle selected
215—bundles of bars of specified diameters
16—bridge crane
17—support frame
19—shearing machine
20—operator
21—control panel
22—bundle being prepared
122—bundle already prepared
222—bundle being sheared
23—means to discharge sheared bars
24—intermediate lifter means
25—container trough
26—container forks
27—extraction jack
28—extraction hook
128—insertion handle
29—latch
30—inclined side
31—substantially vertical side
32—clamping gripper
33—feeder means
34—supports
35—movable gripper
36—abutment plate
136—fully forward position
236—fully backward position
37—alignment jack
38—movable jaw
39—jack to close gripper
139—jack to displace gripper
40—gripper-bearing carriage
41—shaft of a jack
42—guides
142—guides for movable jaw
43—alignment and abutment assemblage
44—advancement means 45—main casing
45A—feeding position
45B—engagement position
145—vertical guides
245—jack
46—horizontally movable casing
46A—forward position
146—actuator jack
47—lower rollers
48—vertically movable casing
48A—engagement position
148—jack
49—upper rollers
50—stationary abutment
51—movable abutment
51A—forward position
151—jack.

We claim:

1. A device to feed and shear bars, the device comprising:

a machine to shear bars to size from a bundle to be sheared, at least one support frame located upstream of said machine for holding the bundle of bars to be sheared, advancement means connected to said support frame to advance the support frame along a feed path and thereby advance all of the bars in said bundle simultaneously in a lengthwise direction, and means disposed along said path to align and butt the bundle of bars so as to prepare them for shearing, said means to align and butt the bundle of bars including a gripper means operable between an open and closed position, an abutment plate movable along said feed path between forward and rearward positions, and means to laterally move said gripper means along said feed path between a first and second position; movement of said gripper means from said open to said closed position constraining the bundle of bars therein, movement of the gripper means from said first position to said second position bringing the bundle of constrained bars into contact with the abutment plate and thereby moving the abutment plate from its forward to its rearward position, movement of said gripper means from said closed position to said open position releasing said bundle of bars, and movement of said abutment plate from said rearward position to said forward position aligning the bundle of bars for shearing.

2. The device to feed and shear bars as claimed in claim 1 and further including an intermediate lifter means at a position central to the bundle of bars.

3. The device to feed and shear bars as claimed in claim 2 in which the position of the intermediate lifter means is adjustable.

4. The device to feed and shear bars as claimed in claim 1 in which the support frame comprises a container trough adjacent to the means to align and butt.

5. The device to feed and shear bars as claimed in claim 4 in which the container trough includes terminally a lower inclined portion and an upper substantially vertical portion of one of its sides.

6. The device to feed and shear bars as claimed in claim 1 in which the means to move the gripper means comprises a gripper jack for moving said gripper means between said first and second positions in a direction substantially lengthwise to the bundle of bars.

7. The device to feed and shear bars as claimed in claim 1 which further comprises an alignment jack for operating the movable abutment plate.

8. The device to feed bars and shear as claimed in claim 1, in which the support frame comprises means for supporting the bundle of bars intermediate its ends, each of the bars in said bundle being disposed on said frame along an arcuate path.

9. The device to feed and shear bars as claimed in claim 1, which further comprises:

means spaced from said feed path and defining a storage location for additional bundles of bars, and carriage means cooperating with said support frame and movable between said storage location and said frame for transporting an additional bundle thereto.

10. A device to feed and shear bars, the device comprising:

a machine to shear bars to size from a bundle to be sheared, at least one support frame located upstream of said machine for holding the bundle of bars to be sheared, advancement means connected to said support frame to advance the support frame along a feed path, the support frame including a latch which cooperates with the advancement means, and means disposed along said path to align and butt the bundle of bars so as to prepare them for shearing, said means to align and butt the bundle of bars including a gripper means operable between an open and closed position, an abutment plate movable along said feed path between forward and rearward positions, and means to laterally move said gripper means between a first and second position, movement of said gripper means from said open to said closed position constraining the bundle of bars therein, movement of the gripper means from said first position to said second position bringing the bundle of constrained bars into contact with the abutment plate and thereby moving the abutment plate from its forward to its rearward position, movement of said gripper means from said closed position to said open position releasing said bundle of bars, and movement of said abutment plate from said rearward position to said forward position aligning the bundle of bars for shearing.

11. A device to feed and shear bars, the device comprising:

a machine to shear bars to size from a bundle to be sheared, at least one support frame located upstream of said machine for holding the bundle of bars to be sheared, advancement means connected to said support frame to advance the support frame along a feed path, the advancement means including a movable extraction hook and an extraction jack for moving said hook, and means disposed along said path to align and butt the bundle of bars, said means to align and butt the bundle of bars so as to prepare them for shearing, said means to align and butt the bundle of bars including a gripper means operable between an open and closed position, an abutment plate movable along said feed path between forward and rearward positions, and means to laterally move said gripper means between a first and second position, movement of said gripper means from said open to said closed position constraining the bundle of bars therein, movement of the gripper means from said first position to said second position bringing the bundle of constrained bars into contact with the abutment plate and thereby moving the abutment plate from its forward to its rearward position, movement of said gripper means from said closed position to said open position releasing said bundle of bars, and movement of said abutment plate from said rearward position to said forward position aligning the bundle of bars for shearing.

12. A device to feed and shear bars the device comprising:

a machine to shear bars to size from a bundle to be sheared, at least on support frame located upstream of said machine for holding the bundle of bars to be sheared, advancement means connected to said support frame to advance the support frame along a feed path, means disposed along said path to align and butt the bundle of bars, so as to prepare them for shearing said means to align and butt the bundle of bars including a gripper means operable between an open and closed position, an abutment plate movable along said feed path between forward and rearward positions, and means to laterally move said gripper means between a first and second position, movement of said gripper means from said open to said closed position constraining the bundle of bars therein, movement of the gripper means from said first position to said second position bringing the bundle of constrained bars into contact with the abutment plate and thereby moving the abutment plate from its forward to its rearward position, movement of said gripper means from said closed position to said open position releasing said bundle of bars, and movement of said abutment plate from said rearward position to said forward position aligning the bundle of bars for shearing, and feeder means disposed along said path and responsive to the alignment of said bundle of bars for advancing the bundle to said machine, the feeder means including at least one lower and upper roller to position and clamp said bundle of bars to be sheared.

13. The device to feed and shear bars as claimed in claim 12 in which at least the lower roller of the feeder means are movable.

14. A device to feed and shear bars, the device comprising:

a machine to shear bars to size from a bundle to be sheared, at least one support frame located upstream of said machine for holding the bundle of bars to be sheared, advancement means connected to said support frame to advance the support frame along a feed path, means disposed along said path to align and butt the bundle of bars so as to prepare them for shearing, said means to align and butt the bundle of bars including a gripper means operable between an open and closed position, an abutment plate movable along said feed path between forward and rearward positions, and means to laterally move said gripper means between a first and second position, movement of said gripper means from said open to said closed position constraining the bundle of bars therein, movement of the gripper means from said first position to said second position bringing the bundle of constrained bars into contact with the abutment plate and thereby moving the abutment plate from its forward to its rearward position, movement of said gripper means from said closed position to said open position releasing said bundle of bars, and movement of said abutment plate from said rearward position to said forward position aligning the bundle of bars for shearing, and feeder means disposed along said path and responsive to the alignment of said bundle of bars for advancing the bundle to said machine, the feeder means including abutments to clamp laterally the bundle of bars to be sheared, at least one of such abutments being movable.

* * * * *